US005172524A

United States Patent [19]

Poss

[11] Patent Number: 5,172,524

[45] Date of Patent: Dec. 22, 1992

[54] SANDING BLOCK

[76] Inventor: Willie A. Poss, R.R. 1, Box 363, 2003 Okoboji Ave., Milford, Iowa 51351

[21] Appl. No.: 702,295

[22] Filed: May 20, 1991

[51] Int. Cl.[5] ..... B24D 15/04; B24D 15/00; B24D 17/00

[52] U.S. Cl. ..... 51/372; 51/371; 51/382

[58] Field of Search ..... 51/373, 372, 371, 368, 51/367, 365, 381, 382, 383, 391, 392

[56] References Cited

U.S. PATENT DOCUMENTS

| | | | |
|---|---|---|---|
| 2,400,928 | 5/1946 | Hein | 51/187 |
| 2,519,486 | 8/1950 | Lovejoy | 51/371 |
| 2,761,257 | 9/1956 | Mendelsohn | 51/186 |
| 3,063,208 | 11/1962 | Bell et al. | 51/372 |
| 3,106,806 | 10/1963 | Hutchins | 51/187 |
| 3,510,991 | 5/1970 | Bowen | 51/372 |
| 3,562,967 | 2/1971 | Erickson | 51/372 |
| 4,475,317 | 10/1984 | Dicke | 51/382 |

*Primary Examiner*—Frank T. Yost
*Assistant Examiner*—Paul M. Heyrana, Sr.
*Attorney, Agent, or Firm*—Morton S. Adler

[57] ABSTRACT

A hand sanding block is formed with two blocks, which may be of equal or unequal lengths, of like cross section and disposed in coplanar relationship with opposed inner ends. The blocks are freely movable towards away from each other, event to the point of total separation, by means of a pair of spaced dowel pins projecting from one block for telescopic engagement in corresponding spring loaded sockets in the other block and are normally held apart in spaced relationship by the springs in the sockets. For mounting and removing an endless sanding belt or an abrasive sanding strip, the blocks are pressed together so the inner ends are in abutting relationship and once the belt or strip is in place, the holding pressure is released so the block can move apart to provide tension on the belt or strip. The block with the sockets has a transverse opening, communicating with the sockets and the dowel pins, into which a removable stop is inserted for wedging engagement against the dowel pins to hold them immovable for maintaining the inner ends of the blocks together to mount or remove the belt or strip. A resilient tether is secured across the opposed inner ends to prevent the total separation of the blocks at any time.

13 Claims, 2 Drawing Sheets

SANDING BLOCK

BACKGROUND OF THE INVENTION

This invention relates to improvements in sanding blocks of the type adaptable for use with a continuous loop sanding belt or with strips of sanding paper or the like attached thereto.

More particularly, this invention relates to the type of sanding block that includes a pair of like cross section components, which may be of equal or unequal lenths, disposed in coplanar relationship and normally held in spaced relationship by a relatively strong spring means to provide tension on an attached endless belt or to a strip of sanding material extending over one coplanar side and removably attached to the opposite ends of the blocks. Such types of sanding blocks are well known as exemplified in U.S. Pat. Nos. 2,761,257, 3,106,806 and 2,400,928.

This type of sanding block usually includes one or more dowel pins on one component that are slidably and removably journalled in corresponding spring loaded sockets of the other component and with this type of block, the two components are manually pressed or wedged together, and must be maintained in that position, while at the same time handling the belt or strip for mounting or removal. While this is basically a simple task, since the two components are freely movable relative to each other even to the point of complete separation, any loss of the manual grip on the pressed together components before the belt or strip is adequately in place will result in the components moving away from each other under the force of the springs and, depending upon the strength of the springs being used, one of the components can be propelled in a projectile like fashion to cause injury or damage in addition to the inconvenience and nuisance involved. One approach to this problem has been an exteriorily mounted latch means to hold the two components of the block together and the present invention discloses a different, novel and simple but effective means for accomplishing the same purpose.

It has also been observed in the use of two component sanding block as characterized that if the belt or strip should accidentally come off due to wear, tearing, or otherwise, the two components will also move apart as described. This is a further disadvantage with this type of block and, accordingly, another object of this invention is to provide a means to keep the two components of such sanding block from complete separation with or without a belt or strip.

SUMMARY

In accordance with this invention, a hand sanding block is formed with two blocks, which may be of equal or unequal length, of like cross section and disposed in coplanar relationship with opposed inner ends. The blocks are freely movable towards and away from each other, even to the point of total separation, by means of a pair of spaced dowel pins projecting from one block for telescopic engagement in corresponding spring loaded sockets in the other block and are normally held apart in spaced relationship by the springs in the sockets. For mounting and removing an endless sanding belt or an abrasive sanding strip, the blocks are held pressed together so the inner ends are in abutting relationship and once the belt or strip is in place, the holding pressure is released so the blocks can move apart to provide tension on the belt or strip. The block with the sockets has a transverse opening, communicating with the sockets and the dowel pins, into which a removable stop is inserted for wedging engagement against the dowel pins to hold them immovable for maintaining the inner ends of the blocks together to mount or remove the belt or strip. A resilient tether is secured across the opposed inner ends to prevent the total separation of the blocks at any time.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 1:
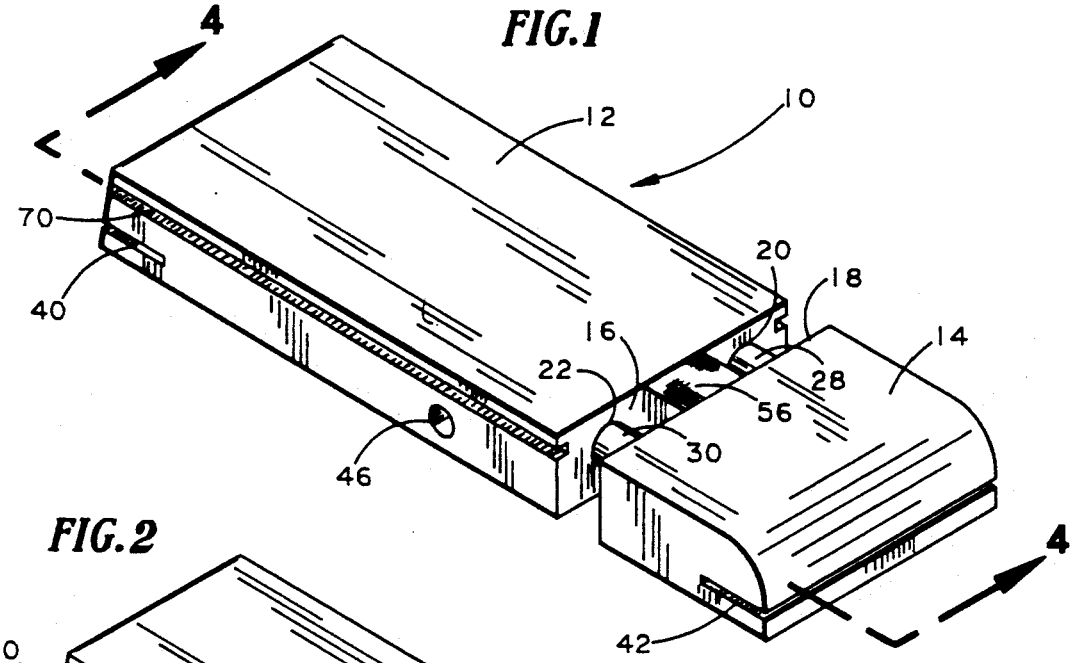
FIG. 1 is a perspective view of a sanding block in extended position constructed according to this invention.

REferring to the drawings, this new sanding block is designated generally by the numeral 10 and includes two blocks 12,14 of like cross section and disposed in coplanar alignment to define the opposed inner ends 16,18. Blocks 12,14 are shown unequal in length but they may be of like dimensions for purposes of the present invention.

Figure 5:
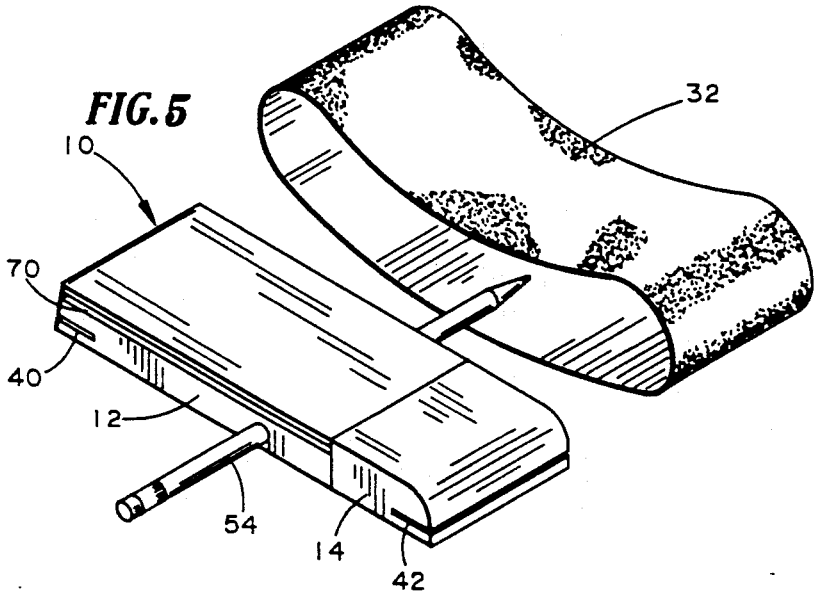
FIG. 5 is a perspective exploded view showing this sanding block held in contracted position according to this invention and an endless sanding belt for mounting thereon.
Figure 6:
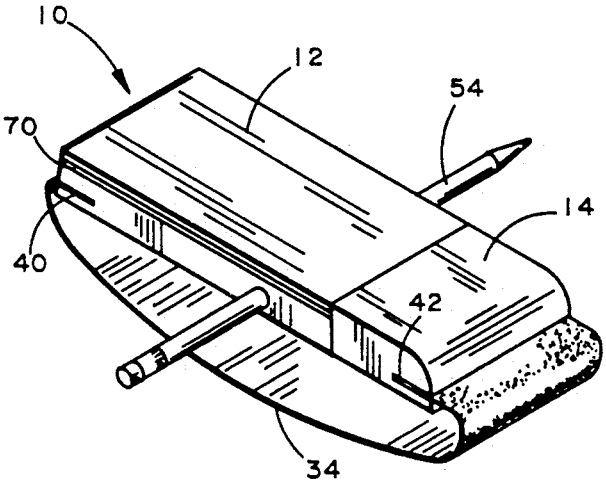
FIG. 6 is a perspective view showing this sanding block in the position of FIG. 5 for mounting a strip of sanding material thereon.

Block 12 is provided with a pair of spaced axial sockets 20,22 communicating with the inner end 16 and in which sockets are the respective coil springs 24,26. Block 14 is provided with a pair of dowel pins 28,30 projecting from inner end 18 and disposed for telescopic engagement in the respective sockets 20,22 against springs 24,26 so that there is free relative movement between blocks 12,14 towards each other to abutting relationship (FIG. 4*b*) and away from other which can be a total separation. Springs 24,26 normally urge blocks 12,14 in spaced apart relationship (FIG. 4*a*) to provide tension on a mounted sanding belt 32 (FIG. 5) or a sanding strip 34 (FIG. 6) in a well known manner.

The outer end of block 12 is slightly bevelled as at 36 and the outer end of block 14 is rounded as at 38 to provide different angled surfaces for sanding in a well known manner. Also, block ends 36,38 are provided with a respective transverse slot or kerf 40,42 to receive a strip of abrasive material 34, such as sandpaper, emery cloth, screen cloth or the like. The top and bottom and ends of blocks 12,14, except for the area of the kerfs 40,42, are preferably provided with a layer of felt 44 or the like to provide a frictional surface for the belt or strip.

A sanding block constructed substantially in the same form as that so far described has long been known where blocks 12,14 are pressed into abutting relationship against the pressure of springs 24,26 and must be held in that position to reduce the overall length of the two blocks to permit the encircling of the same by an endless belt 32 and after which, the pressure on the blocks is released so the blocks can move apart under the force of springs 24,26 to provide tension on the belt and keep it in place. The blocks are also pressed together for removing the belt and this same procedure is used for a mounting a strip 34 where the ends thereof are squeezed into kerfs 40,42 while the blocks are abutted and are held in place by tension when the blocks are released.

It has been observed with blocks of the type so far described, that while the procedure for mounting and removing either a belt 32 or a strip 34 is a relatively simple task, blocks 12,14 with this form of a block are freely movable relative to each other even to the point of complete separation so that any loss of one's grip on the pressed together blocks before the belt or strip is adequately in place and while one is simultaneously trying to handle such belt or strip, will release the tension on the compressed springs causing the blocks to move away from each other and, depending upon the force of the springs, this can be a complete separation of the blocks with one likely to move in a projectile-like fashion that can be a source of injury or damage in addition to the inconvenience and nuisance involved.

It is thus one of the important objects of this invention to overcome the disadvantages of the sanding block so far described and this has been accomplished in the following manner.

Figure 4A:
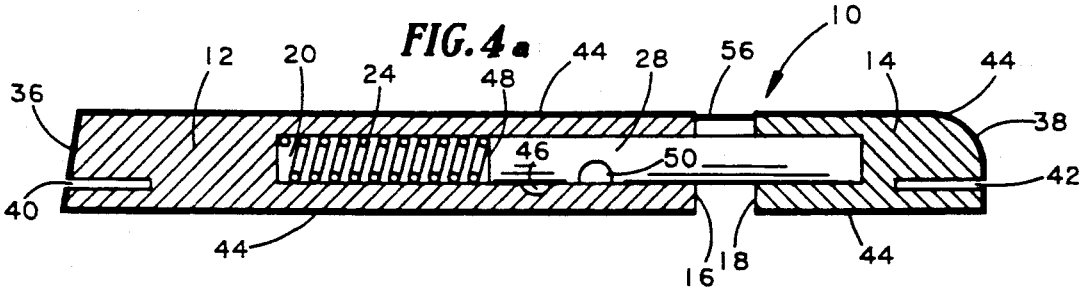
FIG. 4*a* is a cross sectional view taken on the line 4—4 of FIG. 1 showing this sanding block in extended position.
Figure 4B:
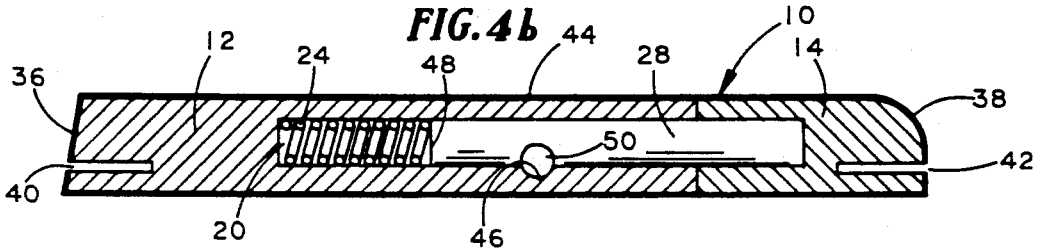
FIG. 4*b* is a cross sectional view also taken on the line 4—4 of FIG. 1 to show the contracted position of this sanding block.

Block is provided with a through transverse opening 46 at a point intermediate inner end 16 and the outermost point 48 of the compressed position of springs 24,26 as best seen in FIGS. 4*a*,4*b* and the plane of opening 46 is located so that the upper half thereof passes through the lower half of sockets 20,22 whereby, with blocks 12,14 expanded as seen in FIG. 4*a*, the free end portions of the dowel pins 28,30 extend through the area forming the upper half of opening 46 within sockets 20,22. Each dowel pin 28,30 is provided with a respective notch 50,52 on its underside at a point spaced inwardly from the respective free ends thereof so that when the blocks 12,14 are expanded, notches 50,52 will be in spaced relationship from opening 46 towards the inner end 16 as seen in FIG. 4*a*. With this arrangement, when blocks 12,14 are pressed into abutting position, (FIG. 4*b*), such notches register with opening 46 and complement the same to form a full circle opening for which, in the area of sockets 20,22, the upper half of such opening is formed by the notches 50,52 in dowel pins 28,30 and the lower half is in block 12 below the lower plane of sockets 20,22 as shown relative to notch 50 in FIG. 4*b*.

Figure 2:
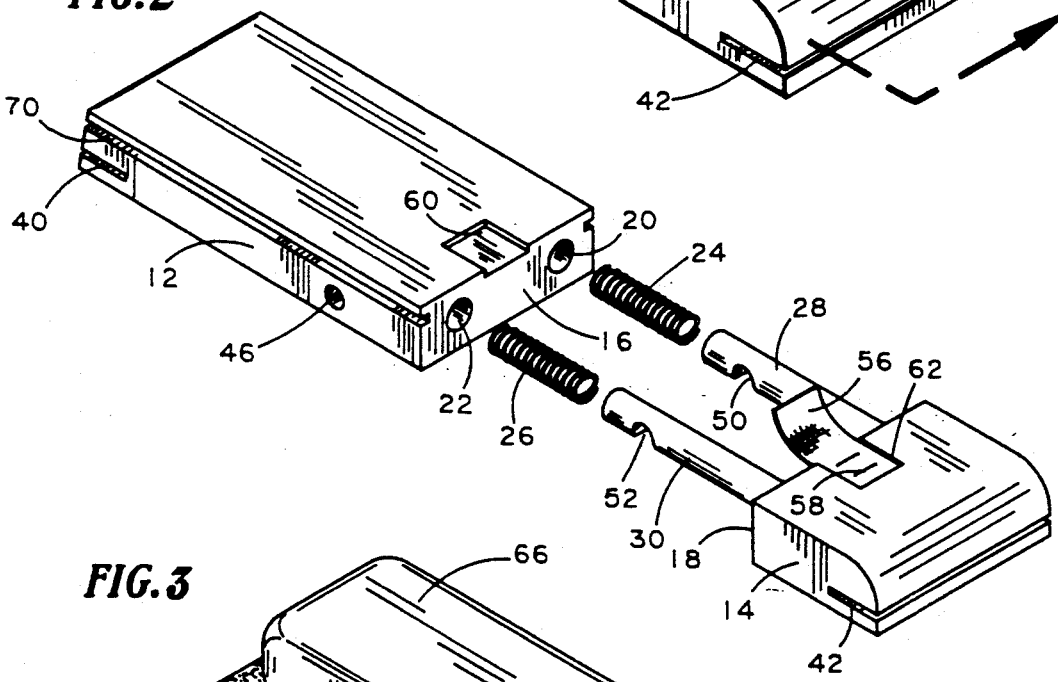
FIG. 2 is a perspective exploded view thereof to show the relative position of the component parts.

A suitably sized stop 54 is removably inserted into opening 46 and into the full circle opening formed by notches 50,52 as described whereby, in the area of sockets 20,22, stop 54 is in wedge engagement with both block 12 and dowel pins 28,30 to prevent any movement of such dowel pins and thus maintain the inner ends 16,18 in abutting relationship for purpose of mounting or removing a belt 32 or strip 34. The diameter of opening 46 is such that it will accept an ordinary lead pencil (FIG. 5) since such an item will usually be available where sanding work is done. Thus, no special tool is required and any like item such as a small bolt or dowel (not shown) can be advantageously used for the purposes described for stop 54. Also, while stop 54 as shown, extends completely through block 12 so as to engage both dowel pins 28,30, this is not required and it is only necessary that such stop engage a notch in one dowel. For this purpose, stop 54 can be inserted from either side of block 12. Once the belt 32 or strip 34 is in place, stop 54 is removed so that blocks 12,14 will move to expanded position to provide the necessary tension for the belt or strip. Removal of the belt or strip is accomplished by returning blocks 12,14 to the position shown in FIG. 5. When a strip 34 is used, the slots or kerfs 40,42 should be narrow enough for a snug fit of the ends of the strip and deep enough to prevent such ends from coming out when tension is applied. Supplementary to stop 54, I have provided means to permit a limited movement of blocks 12,14 away from each other without total separation in the event a user might lose his grip on holding the blocks together when mounting the belt 32. For this purpose, a resilient strip 56 is attached by staples 58 to respective recesses 60,62 in blocks 12,14 as seen in FIG. 2 and this serves as a safety factor in keeping blocks 12,14 from accidentally flying totally apart under tension of springs 24.

Figure 3:
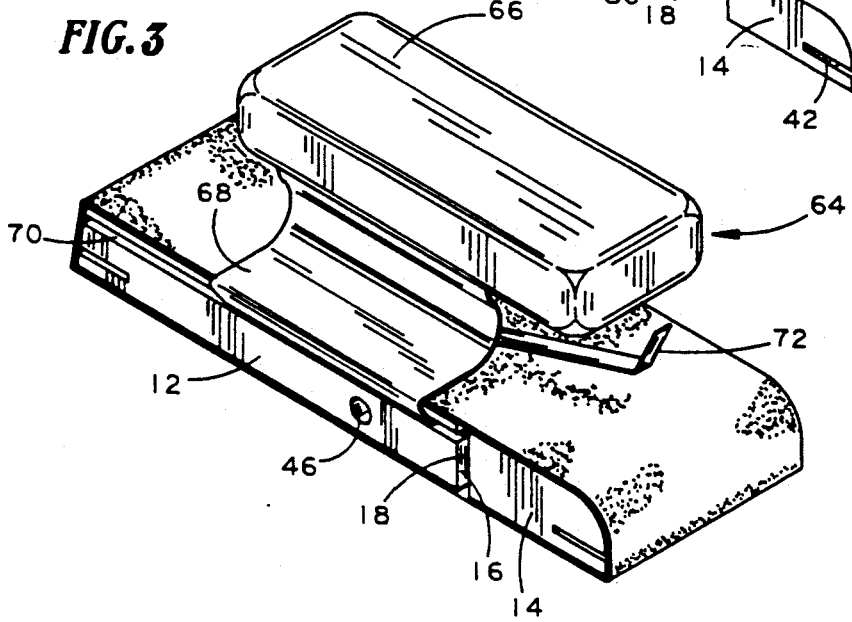
FIG. 3 is a perspective view of this block shown equipped with a removable handle.

As a further convenience in using block 10, I have provided a longitudinal groove 70 on each side of block 12 near the upper surface thereof to removably receive a handle 64 as seen in FIG. 3. Handle 64 has a hand grip portion 66 with depending diverging crimped clips 68 for slidable engagement in grooves 70 together with a lever 72, in a well known manner, for tightening clips 68. No invention is claimed in this form of handle, per se.

Accordingly, in view of the foregoing, it is thought a full understanding of the construction and operation of this invention will be had and the advantages of the same will be appreciated.

I claim:

1. A sanding block, comprising:

two coplanar aligned blocks having opposed inner ends for selectively carrying an endless belt and a strip of sanding material extending over one coplanar side of said blocks and removably attached thereto, means interiorily of said blocks affording free relative movement of said blocks away from each other to a point of total separation and towards each other to an abutting position of said inner ends, spring means in one of said blocks to normally urge said blocks into spaced apart relationship, and means operable between said inner ends for limiting movement thereof away from each other to prevent the complete separation of said blocks from each other.

2. A device as defined in claim 1 wherein said last mentioned means is a resilient tether.

3. A device as defined in claim 1 including the combination therewith of a handle and a means for removably attaching said handle to one of said blocks.

4. A device as defined in claim 3, including:

said blocks including coplanar respective flat sides, the sides of one block provided with a longitudinal groove, and clip means on said handle for removable slidable engagement in said grooves.

5. A device as defined in claim 4 including the combination therewith of a handle and a means for removably attaching said handle to one of said blocks.

6. A device as defined in claim 5 including:

said blocks including coplanar respective flat sides, the sides of one block provided with a longitudinal groove, and clip means on said handle for removable slidable engagement in said grooves.

7. A sanding block, comprising:

first and second coplanar aligned blocks having opposed inner ends, the inner end of said first block being provided with a recess, a coil spring in said recess, a dowel pin mounted in the inner end of said second block and projecting therefrom for free telescopic engagement within said recess and against said spring, said spring disposed to yieldingly hold said blocks in spaced apart relationship for applying tension selectively to any endless sanding belt arranged on said blocks and to any strip of sanding material extending over one coplanar side of said blocks and removably attached thereto, said blocks adapted to be manually moved into abutting relationship for mounting and removing a sanding material, said first block being provided with a transverse opening, and means for removably engaging said dowel pin through said opening when said blocks are in abutting relationship to hold said blocks against relative movement away from each other.

8. A device as defined in claim 7, including:

said dowel pin being provided with a notch disposed so that when said blocks are in abutting position, said notch is in registration with said opening, and a stop member removably insertible into said opening for engagement with notch to hold said dowel pin against movement relative to said recess.

9. A device as defined in claim 8 wherein said stop member is an ordinary lead pencil.

10. A device as defined in claim 7 including means operable between said inner ends to prevent said blocks from becoming completely separated in any movement away from each other.

11. A device as defined in claim 10 wherein said means is a resilient tether.

12. A device as defined in claim 7 including the combination therewith of a handle and a means for removably attaching said handle to one of said blocks.

13. A device as defined in claim 12 including:

said blocks including coplanar respective flat sides, the sides of one block provided with a longitudinal groove, and clip means on said handle for removable slidable engagement in said grooves.

* * * * *